US005716085A

United States Patent [19]

Kobayashi

[11] Patent Number: 5,716,085

[45] Date of Patent: Feb. 10, 1998

[54] STRIKER OF DOOR LOCK DEVICE

[75] Inventor: Fumio Kobayashi, Ayase, Japan

[73] Assignee: Ohi Seisakusho Co., Ltd., Yokohama, Japan

[21] Appl. No.: 590,755

[22] Filed: Jan. 24, 1996

[30] Foreign Application Priority Data

Jan. 31, 1995 [JP] Japan ..... 7-013372

[51] Int. Cl.[6] ..... E05B 15/02

[52] U.S. Cl. ..... 292/340

[58] Field of Search ..... 292/340, 216, 292/DIG. 64; 403/282, 274

[56] References Cited

U.S. PATENT DOCUMENTS

| | | | |
|---|---|---|---|
| D. 230,565 | 3/1974 | Foote | D8/345 |
| 2,899,224 | 8/1959 | Elliott | 403/274 |
| 4,097,078 | 6/1978 | Tack et al. | 292/216 |
| 4,165,112 | 8/1979 | Kleefeldt | 292/216 |
| 4,466,645 | 8/1984 | Kobayashi | 292/216 |
| 4,602,813 | 7/1986 | Gergoe et al. | 292/340 |
| 4,650,231 | 3/1987 | Shimura et al. | 292/340 |
| 4,733,892 | 3/1988 | Kleefeldt et al. | 292/216 |
| 4,941,696 | 7/1990 | Yamada et al. | 292/340 |
| 4,981,313 | 1/1991 | Makamura | 292/340 |
| 5,050,917 | 9/1991 | Hamada et al. | 292/340 |
| 5,064,229 | 11/1991 | Hamada et al. | 292/340 |
| 5,071,178 | 12/1991 | Brackman et al. | 292/216 |
| 5,125,698 | 6/1992 | Thau | 292/340 |
| 5,163,723 | 11/1992 | Rückert | 292/216 |
| 5,209,531 | 5/1993 | Thau | 292/340 |
| 5,209,532 | 5/1993 | Nakamura et al. | 292/340 |
| 5,215,342 | 6/1993 | Yuge et al. | 292/340 |
| 5,316,354 | 5/1994 | Arabia, Jr. et al. | 292/340 |
| 5,501,495 | 3/1996 | Claucherty | 292/340 |
| 5,529,356 | 6/1996 | Cetnar | 292/340 |

FOREIGN PATENT DOCUMENTS

| | | |
|---|---|---|
| 6-74680 | 9/1994 | Japan . |
| 2 170 263 | 7/1986 | United Kingdom . |
| 2 192 423 | 1/1988 | United Kingdom . |

*Primary Examiner*—Rodney M. Lindsey
*Attorney, Agent, or Firm*—Foley & Lardner

[57] ABSTRACT

A striker for use with a door lock proper has a unique structure. The door lock proper includes a body having a recess, a cover plate fixed to the body to cover the recess and having a striker receiving slot, a shaft extending between the body and the cover plate and a latch plate pivotally disposed about the shaft, the latch plate having a rounded recess which is directed toward an entrance of the striker receiving slot when the latch plate assumes a striker releasing position. The striker includes a base plate and a shank member which extends vertically from the base plate. The shank member is latchedly engageable with the latch plate upon insertion thereof into the striker receiving slot. The shank member has, at a portion thereof engageable with the latch plate, an oval cross section whose major axis extends in the direction along which the shank member travels into the striker receiving slot.

7 Claims, 9 Drawing Sheets

STRIKER OF DOOR LOCK DEVICE

BACKGROUND OF THE INVENTION

1. Field of the Invention

The present invention relates in general to door lock devices for motor vehicles and more particularly to door lock devices of a type which includes a door lock proper mounted to a door and a striker fixed to a vehicle body. More specifically, the present invention is concerned with the striker of the door lock device.

2. Description of the Prior Art

In order to clarify the task of the present invention, one conventional door lock device will be described with reference to FIGS. 16 and 17 of the accompanying drawings.

Referring to FIG. 16, there is shown a striker 100 of the conventional door lock device, which is secured to a vehicle body. The striker 100 comprises a base plate 101 secured to the vehicle body, and a generally U-shaped piece 104 raised from the base plate 101. That is, the U-shaped piece 104 comprises front and rear shank portions 102*a* and 102*b* which are secured at their lower ends to the base plate 101 and a bridge portion 103 which extends between upper ends of the front and rear shank portions 102*a* and 102*b*. The front and rear shank portions 102*a* and 102*b* have each a circular cross section. That is, the U-shaped piece 104 is provided by bending a metal rod having a circular cross section.

Referring to FIG. 17, there is shown a door lock proper 105 of the conventional door lock device, which is mounted to a door and capable of catching the striker 100. The door lock proper 105 comprises a plastic body 106 having a recess, and a metallic cover plate 107 fixed to the body 106 in a manner to cover the recess. The cover plate 107 is formed with a striker receiving slot 107*b* into which the U-shaped piece 104 of the striker 100 is inserted upon closing of the door. As shown, the bottom part 107*a* of the slot 107*b* is shaped semicircular and has the width of "W1" which corresponds to the diameter of the front shank portion 102*a* of the U-shaped piece 104. Between the body 106 and the cover plate 107, there extends a shaft 108 about which a latch plate 109 is pivotally disposed. The latch plate 109 is formed with a rounded recess 109*a* which is engageable with the front shank portion 102*a* of the striker 100. The latch plate 109 is further formed with first and second pawl portions 109*b* and 109*c* at both sides of the rounded recess 109*a*. A locking plate 110 is pivotally connected to the cover plate 107, which is engageable with the first and second pawl portions 109*b* and 109*c* of the latch plate 109. The door lock proper 105 shown in the drawing assumes a locked condition wherein the front shank portion 102*b* of the striker 100 is fully received in the rounded recess 109*a* of the latch plate 109 having the locking plate 110 engaged with the first pawl portion 109*b*.

When the door lock proper 105 is in the locked condition as shown in the drawing, the mechanical strength (which will be referred to as "fore-and-aft mechanical strength" hereinafter for ease of description) of the same against a stress applied in the direction of the axis of the shaft 108 depends on the degree "L1" in which the first pawl portion 109*b* of the latch plate 109 crossing the striker receiving slot 107*b* overlaps the cover plate 107. Furthermore, under such locked condition, the mechanical strength (which will be referred to as "right-and-left mechanical strength hereinafter for ease of description) of the door lock proper 105 against a stress applied in the direction of the arrow "S" depends on the sectional area of the front shank portion 102*a* of the striker 100.

Thus, when, for increasing the mechanical strength of the door lock proper 105, the latch plate 109 is so constructed and arranged as to increase the overlapping degree "L1", the body 106 is inevitably enlarged by a degree corresponding to an enlarged part of the first pawl portion 109*b*.

However, in this case, the door lock proper 105 is compelled to have a bulky construction.

SUMMARY OF THE INVENTION

It is therefore an essential object of the present invention to provide a measure for solving the above-mentioned drawback.

According to the present invention, there is provided a striker of a door lock device, which can provide a door lock proper with increased strength when latched by the same.

According to the present invention, there is further provided a striker of a door lock device, which can provide a door lock proper with increased strength without increasing the size of the door lock proper.

According to a first aspect of the present invention, there is provided an improved striker for use with a door lock proper. The door lock proper includes a body having a recess, a cover plate fixed to the body to cover the recess and having a striker receiving slot, a shaft extending between the body and the cover plate and a latch plate pivotally disposed about the shaft, the latch plate having a rounded recess which is directed toward an entrance of the striker receiving slot when the latch plate assumes a striker releasing position. The improved striker includes a base plate and a shank member which extends vertically from the base plate, the shank member being latchedly engageable with the latch plate upon insertion thereof into the striker receiving slot, the shank member having, at a portion thereof engageable with the latch plate, an oval cross section whose major axis extends in the direction along which the shank member travels into the striker receiving slot.

According to a second aspect of the present invention, there is provided an improved striker for use with a door lock proper. The door lock proper includes a body having a recess, a cover plate fixed to the body to cover the recess and having a striker receiving slot, a shaft extending between the body and the cover plate and a latch plate pivotally disposed about the shaft, the latch plate having a rounded recess which is directed toward an entrance of the striker receiving slot when the latch plate assumes a striker releasing position. The improved striker includes a base plate and a generally U-shaped piece which is raised vertically from the base plate, the U-shaped piece including front and rear shank members secured at lower ends thereof to the base plate and a bridge member extending between upper ends of the front and rear shank members, the front shank member being latchedly engageable with the latch plate upon insertion of the U-shaped piece into the striker receiving slot, each of the front and rear shank members having therethroughout an oval cross section whose major axis extends in the direction along which the U-shaped piece travels into the striker receiving slot.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Referring to FIGS. 1 to 11, particularly FIGS. 3 to 7, there is shown a striker 10 of a door lock device, which is a first embodiment of the present invention.

Figure 1:
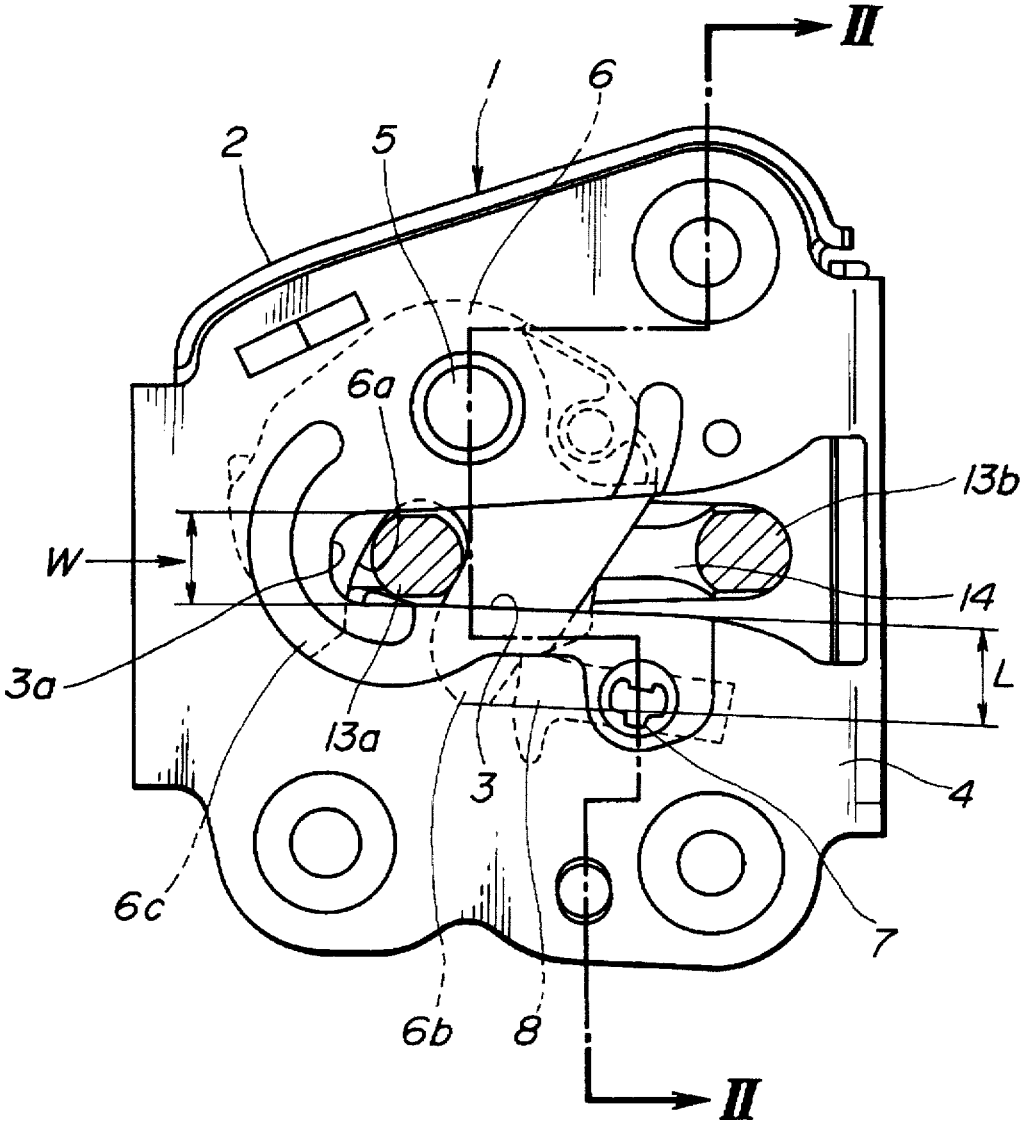
FIG. 1 is a plan view of a door lock proper having a striker operatively received therein, the striker being a first embodiment of the present invention.
Figure 2:
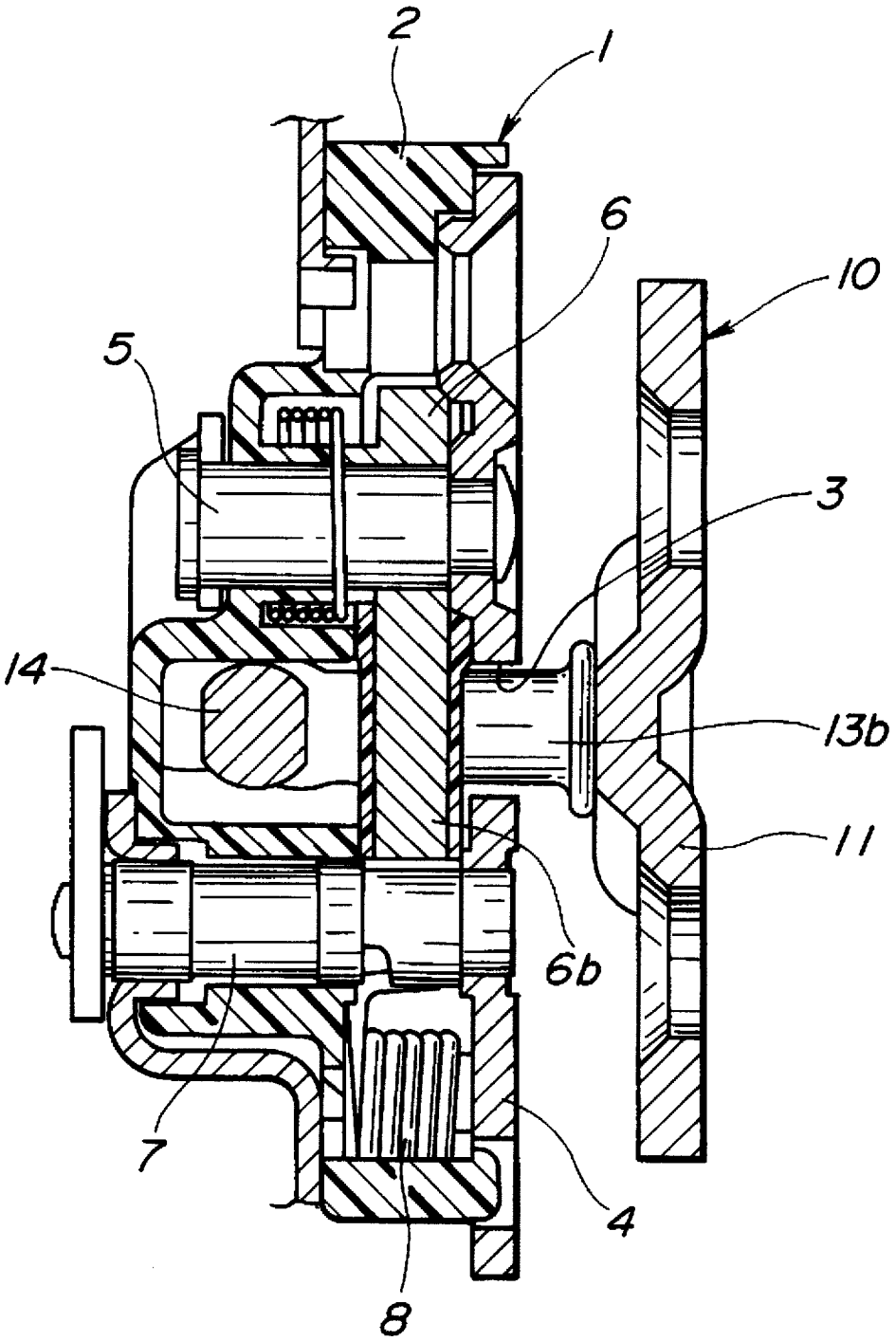
FIG. 2 is a sectional view taken along the line II—II of FIG. 1.
Figure 3:
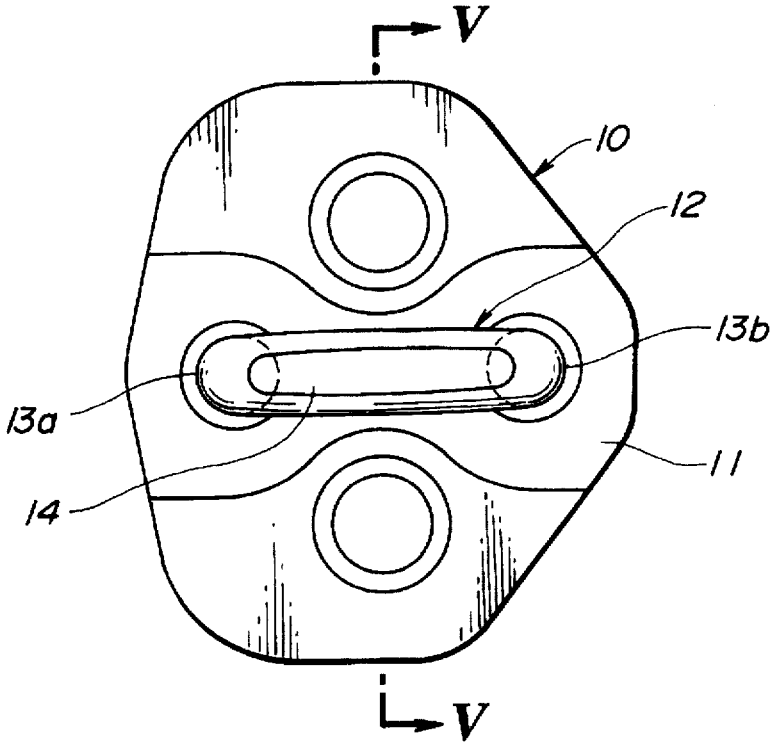
FIG. 3 is a plan view of the striker of the first embodiment.
Figure 17:
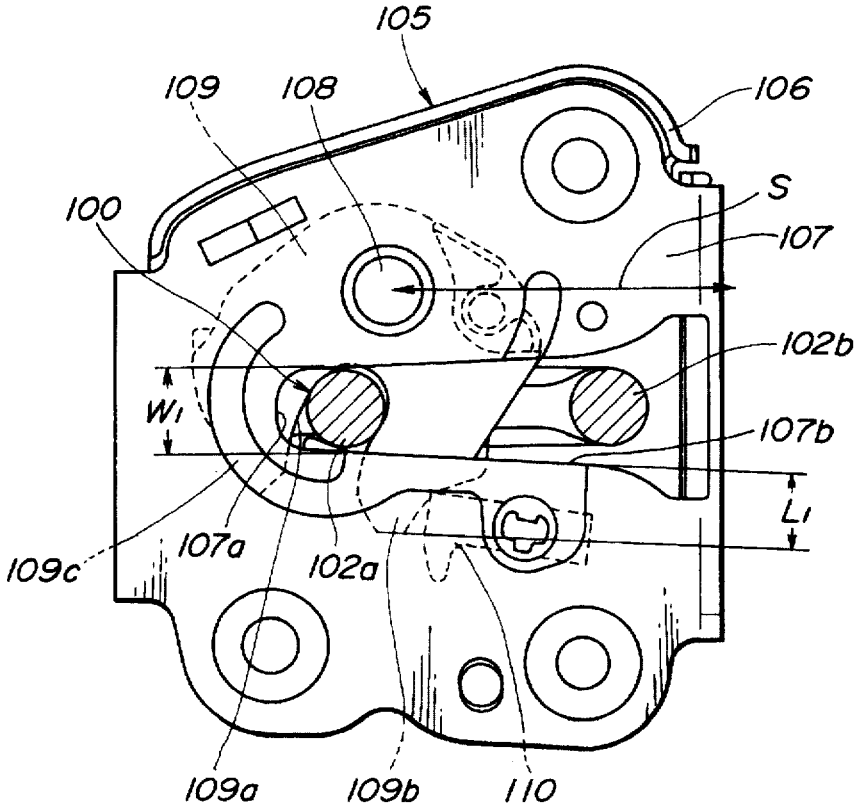
FIG.17 (PRIOR ART)
FIG. 17 is a plan view of a door lock proper having the conventional striker operatively received therein.

As is seen from FIGS. 1 and 2, a door lock proper 1 to which the striker 10 of the invention is engageable has substantially the same construction as the above-mentioned door lock proper 105 of FIG. 17.

That is, the door lock proper 1 comprises a plastic body 2 having a recess, and a metallic cover plate 4 fixed to the body 2 in a manner to cover the recess. The cover plate 4 is formed with a striker receiving slot 3 into which an after-mentioned U-shaped piece (12) of the striker 10 is inserted upon closing of the door. As shown in FIG. 1, the bottom part 3*a*of the slot 3 is shaped semicircular and has a predetermined width "W". Between the body 2 and the cover plate 4, there extends a shaft 5 about which a latch plate 6 is pivotally disposed. A biasing spring (not shown) is connected to the latch plate 6 to bias the same to pivot about the shaft 5 in a counterclockwise direction in the drawing. The latch plate 6 is received in the recess of the body 2 and formed with a rounded recess 6a which is engageable with an after-mentioned front shank portion 13*a*of the striker 10. The latch plate 6 is further formed with first and second pawl portions 6*b* and 6*c* at both sides of the rounded recess 6*a*. Between the body 2 and the cover plate 4, there further extends another shaft 7 about which a locking plate 8 is pivotally disposed. The locking plate 8 is received in the recess of the body 2. When the locking plate 8 engages the second pawl portion 6*c* of the latch plate 6, the latter assumes a so-called half-latch position, while, when the locking plate 8 engages the first pawl portion 6*b* of the latch plate 6, the latter assumes a so-called full-latch position. The door lock proper 2 shown in FIG. 1 assumes a locked condition wherein the front the locking plate 8 engaged with the first pawl portion 6*b*.

Referring to FIGS. 3 to 7, there is shown the striker 10 of the first embodiment of the present invention. As is well shown in FIGS. 3 and 4, the striker 10 comprises a base metal plate 11 bolted to a vehicle body, and a generally U-shaped metal piece 12 raised from the base plate 11. That is, the U-shaped piece 12 comprises front and rear shank portions 13*a*and 13*b* which are secured at their lower ends to the base plate 11 and a bridge portion 14 which extends between upper ends of the front and rear shank portions 13*a*and 13*b*.

Figure 4:
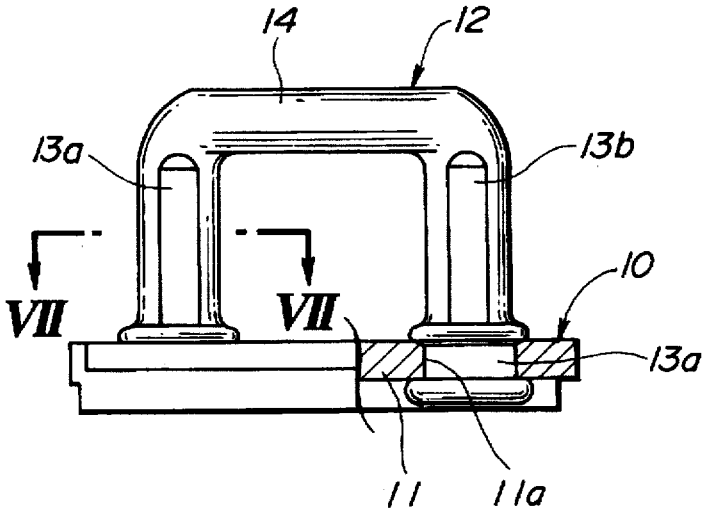
FIG. 4 is a partially cut bottom view of the striker of the first embodiment.
Figure 5:
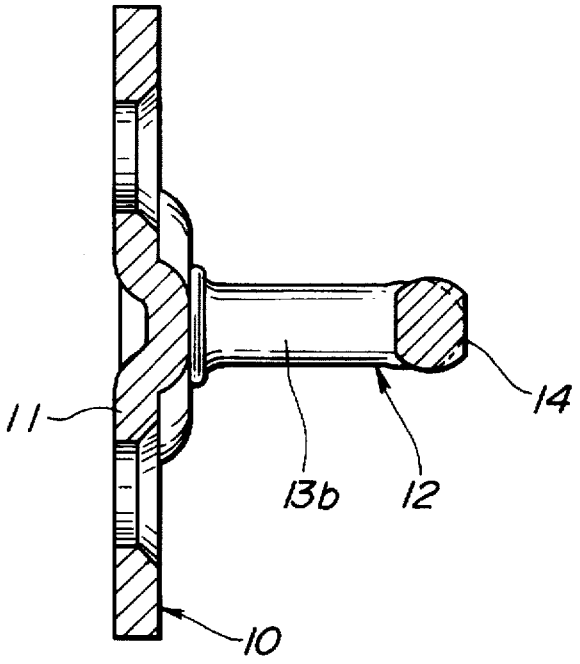
FIG. 5 is a sectional view taken along the line V—V of FIG. 3.

As is understood from FIG. 4, the base plate 11 is formed with two spaced openings 11*a* (only one is shown) into which the lower ends of the front and rear shank portions 13*a*and 13*b* of the U-shaped piece 12 are thrust. Heat-caulking technique is applied for securing the shank portions 13*a*and 13*b* to the base plate 11. That is, first, the U-shaped metal piece 12 is heated up to a certain degree and then mated with the base plate 11 having the lower ends of the shank portions 13*a*and 13*b* thrust into the openings 11*a*. Then, the unit including the U-shaped piece 12 and the base plate 11 is subjected to a pressing process. With this, each shank portion 13*b* or 13*a*is formed with upper and lower bulged portions (no numerals) by which the base plate 11 is tightly sandwiched, as shown. The shape of the U-shaped piece 12 and that of the openings 11*a* of the base plate 11 will be described in detail hereinafter.

Figure 6:
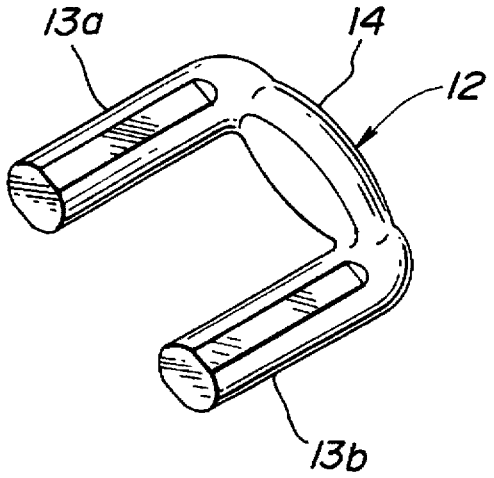
FIG. 6 is a perspective view of a generally U-shaped piece which constitutes a part of the striker of the first embodiment.
Figure 7:
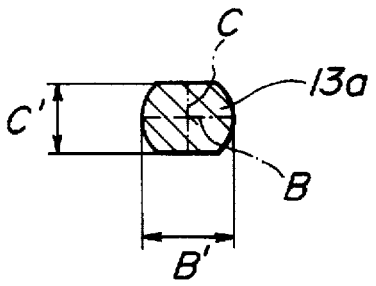
FIG. 7 is a sectional view taken along the line VII—VII of FIG. 4.

As is understood from FIG. 6, by bending a metal rod having a circular cross section, the U-shaped piece 12 is provided. Then, the piece 12 is subjected to a pressing process to press the front and rear shank portions 13*a*and 13*b*. With this, diametrically opposed sides of each shank portion 13*a*or 13*b* are pressed and flattened, so that each shank portion 13*a*or 13*b* has a generally oval cross section, as is seen from FIGS. 6 and 7. The oval cross section is so oriented that the major axis "B" (see FIG. 7) thereof extends along the longitudinal axis of the bridge portion 14. Then, the U-shaped piece 12 is secured to the base plate 11.

As is seen from FIG. 1, upon assembly on the vehicle body, the U-shaped piece 12 of the striker 10 is so oriented that the major axes of the front and rear shank portions 13*a*and 13*b* extend in the 10 direction along which the striker receiving slot 3 of the door lock proper 1 travels upon closing and opening movement of the door.

Figure 10:
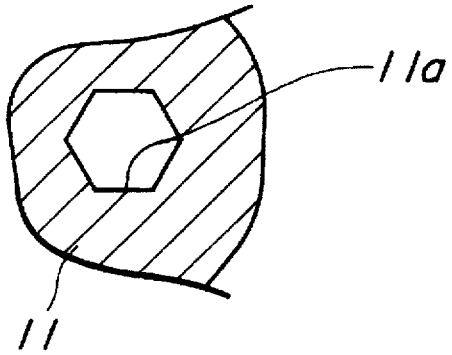
FIG. 10 is a partial plan view of a base plate of the striker at a portion where a connecting opening is formed.

The shape of the openings 11*a* of the base plate 11 is clearly shown in FIG. 10. As shown, each opening 11a is hexagonal in shape, which is somewhat enlarged in the direction of the major axis "B" of oval cross section the corresponding shaft portion 13*a*or 13*b*. Due to provision of angled edges defined by the hexagonal opening 11*a*, the shank portion 13*a*or 13*b* can be tightly locked in the opening 11*a*.

Figure 11:
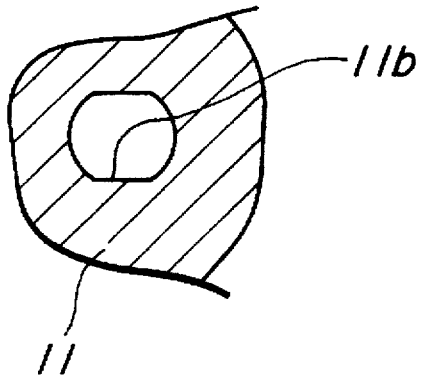
FIG. 11 is a view similar to FIG. 10, but showing a modification of the base plate.

If desired, as is shown in FIG. 11, the openings 11*b* of the base plate 11 may have the same oval shape as the cross section of the shank portions 13*a*and 13*b*.

Figure 8:
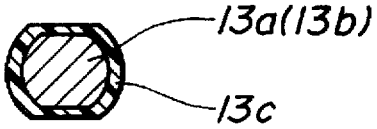
FIG. 8 is a view similar to FIG. 7, but showing a first modification of the U-shaped piece.

Furthermore, if desired, as is seen from FIG. 8, the shank portion 13*a*or 13*b* may be covered with a plastic layer 13*c*. In this case, the cross section of the entire structure including the shank portion and the plastic layer 13*c* should be oval in shape, as shown.

Figure 9:
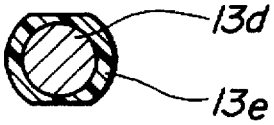
FIG. 9 is a view similar to FIG. 7, but showing a second modification of the U-shaped piece.

Furthermore, if desired, as is understood from FIG. 9, a U-shaped piece may be used wherein the front and rear shank portions 13*d* have each a circular cross section and the plastic layer 13*e* covering the shank portions 13*d* has a generally oval cross section.

Referring back to FIG. 1, preferably, the width "W" of the bottom part 3*a*of the striker receiving slot 3 is determined somewhat greater than the length "C" (see FIG. 7) of the minor axis "C" of the oval cross section of the shank portion 13*a*or 13*b* but smaller than the length "B'" of the major axis "B" of the same.

It is now to be noted that reducing the width "W" of the slot 3 means an increase in overlapping area "L" between the first pawl portion 6*b* of the latch plate 6 and the cover plate 4.

In the following, operation of the door lock device incorporated with the striker 10 will be described with reference to FIG. 1.

For ease of understanding, the description will be commenced with respect to a release condition of the door lock device. Under this condition, the door is opened, and the latch plate 6 assumes a striker releasing portion having the rounded recess 6*a* thereof directed toward the entrance of the striker receiving slot 3. As has been described hereinabove, by the biasing spring connected to the latch plate 6, the latter is biased to pivot toward the striker releasing position.

When now the door is closed with a certain force, the front shank portion 13*a*of the striker 10 comes into the rounded recess 6*a* of the latch plate 6 through the striker receiving slot 3 and thus pivots the latch plate 6 to the full-latch position as shown in the drawing. Upon this, due to work of biasing means (not shown), the locking plate 8 becomes in engagement with the first pawl portion 6*b* thereby holding or locking the latch plate 6 at the full-latch position. With this, the door is held or locked at the fully closed position.

When an outer or inner handle (not shown) of the door is manipulated, the locking plate 8 is pivoted in a direction to release the latch plate 6. Upon this, by a force produced by a weather strip mounted to a door opening of the vehicle body, the latch plate 6 is pivoted to the stand-by position against the force of the biasing spring. Thus, thereafter, the door is ready for opening.

In the following, advantages given by the striker 10 will be described.

(1). When the latch plate 6 is in the full-latch position as shown in FIG. 1, the first pawl portion 6*b* of the latch plate 6 overlaps a lower solid portion of the cover plate 4 while crossing the striker receiving slot 3. Because the overlapping area "L" between them is increased for the reason described hereinabove, the fore-and-aft mechanical strength of the door lock proper 1 is increased.

(2). The front shank portion 13*a*of the striker 10 is so oriented that the major axis "B" of the oval cross section thereof extends in the direction along which the striker receiving slot 3 of the door lock proper 1 travels. This means an increase in modulus of section of the striker 10. Thus, also the right-and-left mechanical strength of the door lock proper 1 is increased.

Figure 12:
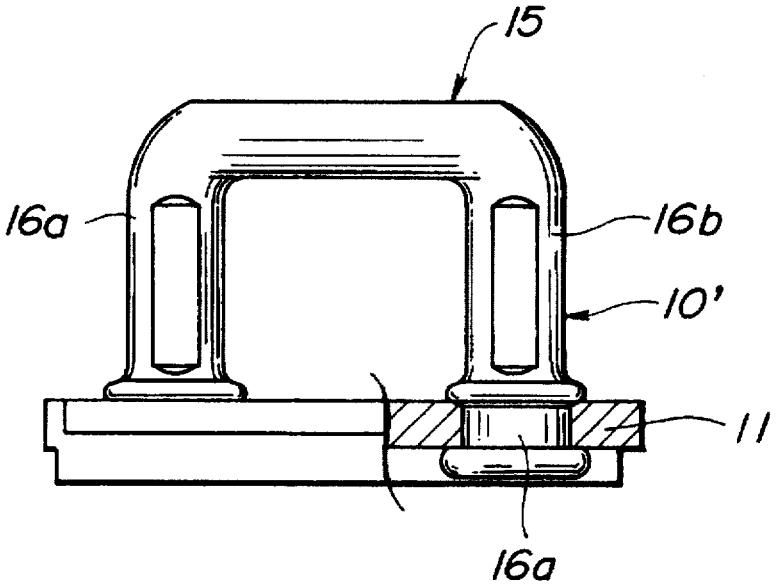
FIG. 12 is a view similar to FIG. 4, but showing a striker of a second embodiment of the present invention.
Figure 13:
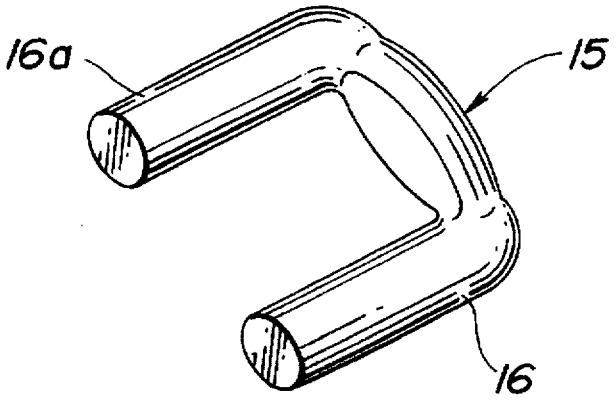
FIG. 13 is a perspective view of a generally U-shaped piece employed in the second embodiment.
Figure 14:
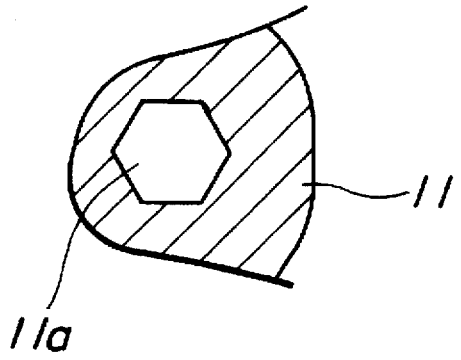
FIG. 14 is a partial plan view of a base plate of the striker of the second embodiment.

Referring to FIGS. 12 to 14, there is shown a striker 10' of a second embodiment of the present invention. For production of this striker 10', the following method is employed.

Figure 15:
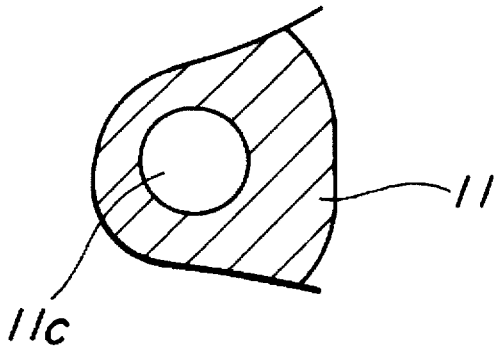
FIG. 15 is a view similar to FIG. 14, but showing a modification of the base plate.
Figure 16:
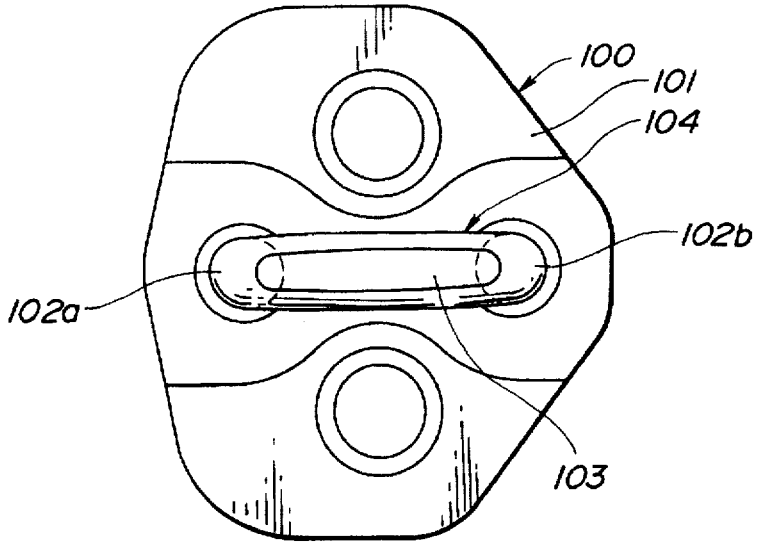
FIG.16 (PRIOR ART)
FIG. 16 is a plan view of a conventional striker.

First, as is seen from FIG. 13, by bending a metal rod having a circular cross section, a U-shaped piece 15 is provided. Then, the piece 15 is secured to the base plate 11 (see FIG. 14) by means of the heat-caulking technique to provide a semi-finish striker. If desired, as is shown in FIG. 15, the openings 11*c* of the base plate 11 may be circular in shape. Then, the semi-finish striker is subjected to a pressing process to press the front and rear shank portions 16*a* and 16*b*. With this, diametrically opposed sides of each shank portion 16*a*or 16*b* are pressed and flattened, so that each shank portion 16*a*or 16*b* has a generally oval cross section.

It is to be understood that, although the invention has been described with specific reference to particular embodiments thereof, it is not to be so limited since changes and alterations therein may be made which are within the full intended scope of this invention as defined by the appended claims.

What is claimed is:

1. A combination comprising:

a door lock including a body having a recess, a cover plate fixed to the body to cover the recess and having a striker receiving slot, a shaft extending along an axis between the body and the cover, and a latch plate pivotable about the axis of the shaft, the latch plate having a rounded recess which is directed toward the entrance of the striker receiving slot when the latch plate assumes a striker releasing position; and a striker including a base and a shank member made entirely of metal projecting from said base for latched engagement with the latch plate upon insertion of the striker into the striker receiving slot;

wherein the metal shank member has, at a portion engageable with the latch plate, a generally oval cross section with a major axis extending in a direction along which the metal shank member travels into the striker receiving slot, and a minor axis extending perpendicular to the major axis.

2. A striker as claimed in claim 1, in which said shank member has one end secured to said base plate through caulking.

3. A striker as claimed in claim 2, in which said base plate is formed with an opening into which said end of said shank member is thrust for achieving heat-caulking.

4. A striker as claimed in claim 3, in which said opening of said base plate is non-circular in shape.

5. A striker as claimed in claim 4, in which said opening of said base plate is hexagonal in shape.

6. A combination as claimed in claim 1, wherein the striker receiving slot has first and second substantially parallel edges, and wherein a distance between the parallel edges is such that a length of the minor axis fits snugly upon insertion of the metal shank member into the striker receiving slot.

7. A combination as claimed in claim 6, wherein the distance between the parallel edges of the striker receiving slot is greater than the length of the minor axis of the metal shank member and less than a length of the major axis of the metal shank member.

* * * * *